United States Patent [19]

Oba et al.

[11] Patent Number: 4,785,785

[45] Date of Patent: Nov. 22, 1988

[54] FUEL INJECTION CONTROL DEVICE FOR AN INTERNAL COMBUSTION ENGINE WITH THROTTLE OPENING DETECTION MEANS

[75] Inventors: Hidehiro Oba, Aichi; Senji Kato, Toyota, both of Japan

[73] Assignee: Toyota Jidosha Kabushiki Kaisha, Aichi, Japan

[21] Appl. No.: 128,709

[22] Filed: Dec. 4, 1987

[30] Foreign Application Priority Data

Dec. 8, 1986 [JP] Japan ..... 61-291732

[51] Int. Cl.[4] ..... F02D 41/18; F02D 41/04

[52] U.S. Cl. ..... 123/488; 123/494

[58] Field of Search ..... 123/478, 480, 494, 488

[56] References Cited

U.S. PATENT DOCUMENTS

| | | | |
|---|---|---|---|
| 3,960,120 | 6/1976 | Aono et al. | 123/478 |
| 4,195,598 | 4/1980 | Anbuf et al. | 123/478 X |
| 4,582,031 | 4/1986 | Janetzke et al. | 123/478 X |

FOREIGN PATENT DOCUMENTS

| | | | |
|---|---|---|---|
| 28031 | 2/1984 | Japan . | |
| 122237 | 6/1985 | Japan . | |
| 2159983 | 12/1985 | United Kingdom | 123/494 |

*Primary Examiner*—Tony M. Argenbright

*Attorney, Agent, or Firm*—Kenyon & Kenyon

[57] ABSTRACT

A fuel injection control device for an internal combustion engine comprising a throttle position sensor, a pressure sensor or a potentiometer for detecting a flow of the intake air in units of a certain physical quantity, and a third detecting device for detecting whether the engine is operating in a steady state. The device further includes a device for estimating the load of the engine from the output of the throttle position sensor and a learning device for correcting the estimation provided by the estimating device based on the output of the air flow sensor when the engine is operating in a steady state, so that the load estimation value can be corrected in accordance with the actual air flow. The amount of fuel to be injected is calculated in response to the most recently corrected load estimation value obtained from the output of the throttle position sensor.

11 Claims, 6 Drawing Sheets

FUEL INJECTION CONTROL DEVICE FOR AN INTERNAL COMBUSTION ENGINE WITH THROTTLE OPENING DETECTION MEANS

BACKGROUND OF THE INVENTION

1. Field of the Invention

The present invention relates to a fuel injection control device for an internal combustion engine. More particularly, it relates to such a device whereby a fuel injection is controlled by detecting a degree of opening of the throttle.

2. Description of the Related Art

The use of electric fuel injectors to supply fuel to the engine is wide-spread, and many fuel injection control devices have been proposed for a precise control of the supply of the fuel in response to the engine operating conditions, to obtain an optimum performance by the engine. These fuel injection control devices can be generally classified into the following types: The type in which the degree of opening of the throttle valve which regulates the flow of the intake air in the engine, and the revolution speed of the engine, is detected, to estimate the amount of fuel to be injected into the engine (c.f., for example, Japanese Unexamined Patent Publication (Kokai) Nos. 59-28031 and 60-122237); the type in which the actual volume of the intake air is detected instead of the above throttle opening; and the type in which the intake air pressure is detected.

The above three types of fuel injection control devices have advantageous control characteristics, respectively. However, it is clear that the fuel injection control device of the first type obtains the quickest response, because the flow of the intake air is controlled by changing the degree of opening of the throttle valve, to bring the operating condition of the engine to a desired condition. Namely, the response in the case of the second and the third types is delayed in comparison to that of the first type, since the above second and third types detect the volume and the pressure of the intake air, respectively, as a control parameter for the engine load, which phenomena are caused by a change in the degree of opening of the throttle, and since there may be a delay in the response of the air flow meter and pressure sensor when detecting these parameters.

Nevertheless, an injection control device in which the amount of the fuel to be injected in the engine is determined by detecting the degree of opening of the throttle valve and the revolution speed of the engine is not without problems.

Fundamentally, the amount of fuel required by the engine should be decided in correspondence with the flow of the intake air and the revolution speed of the engine, and in the case of the first type of fuel injection control device, the degree of opening of the throttle valve is used as a parameter for estimating the flow of the intake air. If the degree of opening of the throttle valve completely corresponds to the flow of the intake air, the above estimation will accurately represent the actual flow of the intake air, and the decision on the amount of fuel required will rapidly follow and maintain correspondence with the amount of fuel required to establish a good response.

However, the relationship between the degree of opening of the throttle valve and the actual flow of the intake air cannot be assumed to be always in complete correspondence, since some engines are provided with idle speed control devices comprising a bypass air passage with bypasses the throttle valve, for controlling the idle speed and warming up operation of the engine by changing the flow area of the bypass air passage. Also, some air leakage will flow into the intake air passage without passing through the throttle valve, or the volumetric efficiency will change due to a change of back pressure or in the intake valve characteristic after a long period of use. Also, in the detecting means for detecting the degree of opening of the throttle valve, detecting errors may occur in the sensor itself and execution errors may occur in an analog and digital converter or the like as a signal handling means for handling the sensor output, with the result that the accuracy of the detection of the degree of opening of the throttle valve will be limited to a certain extent.

Therefore, it can be considered that the fuel injection control device in which the amount of fuel to be injected is calculated by using the degree of opening of the throttle valve, on one hand, will provide a good control response, but on the other hand, will have a poor control accuracy in comparison to the other types of fuel injection control devices, and thus a problem arises in that such a fuel injection control device cannot be used in an internal combustion engine in which a good fuel economy and emission rate must be realized by controlling the air fuel ratio.

To solve this problem, the above-mentioned Japanese Unexamined Patent Publications (Kokai) No. 59-28031 proposed that the idle speed and warming up control be effected by control of the degree of opening of the throttle valve, instead of by control of the bypass passage, thus shutting off all of the bypass air flow. However, this raises a further problem of providing a complex throttle valve operating mechanism which, nevertheless, cannot precisely control the idle speed.

SUMMARY OF THE INVENTION

It is an object of the present invention to solve the above problems and to provide a fuel injection control device for an internal combustion engine which can control the amount of fuel to be injected by detecting the degree of opening of the throttle valve to obtain not only a good response but also a good accuracy, irrespective of the presence of air bypassing, or leaking air bypassing, the throttle valve, a change in the volumetric efficiency, and/or an error in detecting the degree of opening of the throttle valve.

According to the present invention, there is provided a fuel injection control device for an internal combustion engine having an intake air passage with a throttle valve and a fuel injector arranged therein, the fuel injection control device comprising: a first detecting means for detecting the degree of opening of the throttle valve; a second detecting means for detecting the flow of the intake air in the intake air passage in units of a certain physical quantity, preferably the volume or the pressure of the intake air flow; a third detecting means for detecting whether the engine is operating in a steady state, i.e., the engine is operating at a constant revolution speed; means for estimating the load of the engine from the output of the first detecting means in accordance with a predetermined estimation to provide a load estimation value represented by said units; learning correcting the estimation provided by the estimating device based on the output of the second detecting means when the third detecting means detects that the engine is operating in a steady state; and means for calculating the amount of fuel to be injected in response to the most recently corrected load estimation value obtained from the output of the first detecting means.

It will be understood by a person having ordinary skill in the art that the amount of the fuel to be injected can be calculated in accordance with a load estimation value if the flow of intake air is known. According to the present invention, the load estimation value is obtained from the output of the first detecting means and represented by the units which are used in the detection by the second detecting means. This output of the second detecting means has been used in conventional engines to calculate the amount of fuel to be injected, by an established calculation method. Therefore, it is possible to conveniently calculate the amount of the fuel to be injected in a conventional manner, according to the present invention, by using the load estimation value obtained from the output of the first detecting means instead of the detection of the volume or pressure of the intake air. Also, as in the conventional devices, the first step of the calculation of the amount of fuel is used to provide a fundamental fuel amount adapted to provide a theoretical air fuel ratio, and correction factors then applied to the fundamental fuel amount in accordance with the engine operating conditions, for example, during warming up or an acceleration of the engine. This calculation technique can be also applied to the present invention, and thus the details of the calculation of the fuel amount are omitted.

The most important feature of the present invention is the learning means, which corrects the estimation to obtain the corresponding relationship between the load estimation value and the actual flow of the intake air, and thus the accuracy of the fuel injection control is greatly improved. Therefore, the load estimation value, according to the present invention, can represent the engine operating condition, in terms of the throttle valve operating timing, for providing a rapid response, and in terms of establishing an accurate control corresponding to the actual flow of the intake air.

Preferably, the estimating means comprises means for storing a load estimating value represented by said units in a predetermined relationship to a degree of opening of the throttle, and means for calculating the load estimation value from this predetermined relationship by assuming that the detected degree of opening of the throttle is a variable, said estimation being corrected by applying a correction factor to the above variable upon a calculation by the estimation means. The learning means includes means for comparing the calculated load estimation value and the detected flow, to change said correction factor so as to decrease the difference therebetween.

Preferably, the third detecting means detects that the variation of the degree of opening of the throttle detected by the first detecting means is lower than a predetermined value, or that the variation of the flow detected by the second detecting means is lower than a predetermined value.

BRIEF DESCRIPTION OF THE DRAWINGS

The present invention will become more apparent from the following description of the preferred embodiment, with reference to the accompanying drawings, in which.

DESCRIPTION OF THE PREFERRED EMBODIMENTS

Figure 1:
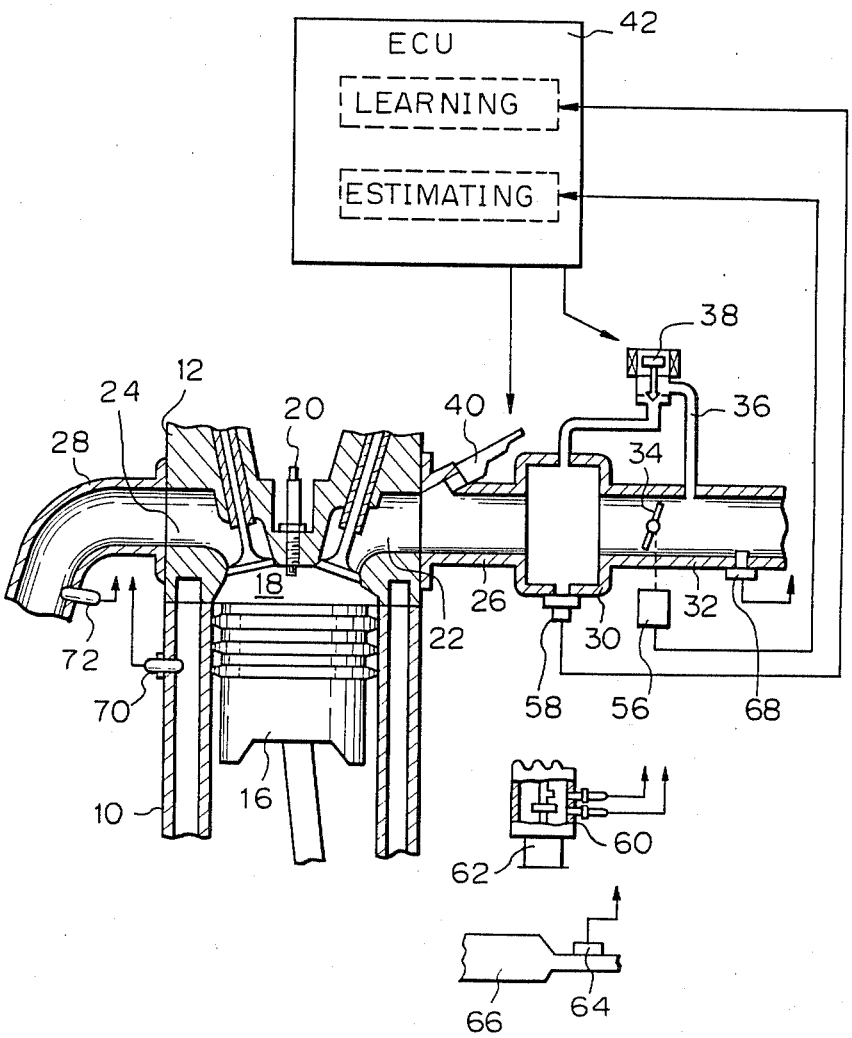
FIG. 1 is a view of an internal combustion engine to which the means according to the present invention is applied.

Referring first to FIG. 1, the internal combustion engine according to the present invention comprises a cylinder block 10 having a cylinder bore therein and a cylinder head 12, a piston 16 being reciprocably arranged in the cylinder bore. A combustion chamber 18 is formed above the piston 16 and a spark plug 20 is mounted on the cylinder head 12. The cylinder head 12 is provided with an intake port 22 and an exhaust port 24 communicating with the combustion chamber 18, and an intake valve and an exhaust valve arranged therein, respectively. An intake manifold 26 and an exhaust manifold 28 are mounted on the cylinder head 12 in communication with the intake port 22 and the exhaust port 24, respectively.

The intake manifold 26 is further connected to a surge tank 30, which in turn, is connected to a throttle body 32 having a throttle valve 34 arranged therein. An air cleaner (not shown) conventionally introduces fresh air into the throttle body 32. A bypass air passage 36 is provided, which is communicated at an upstream end thereof with the throttle body 32 on the upstream side of the throttle valve 34, and at the downstream end thereof, with the surge tank 30. A bypass valve 38, usually referred to as an idle speed control valve, is arranged in the bypass air passage 36, and a fuel injector 40 is mounted on the intake manifold 26.

Figure 2:
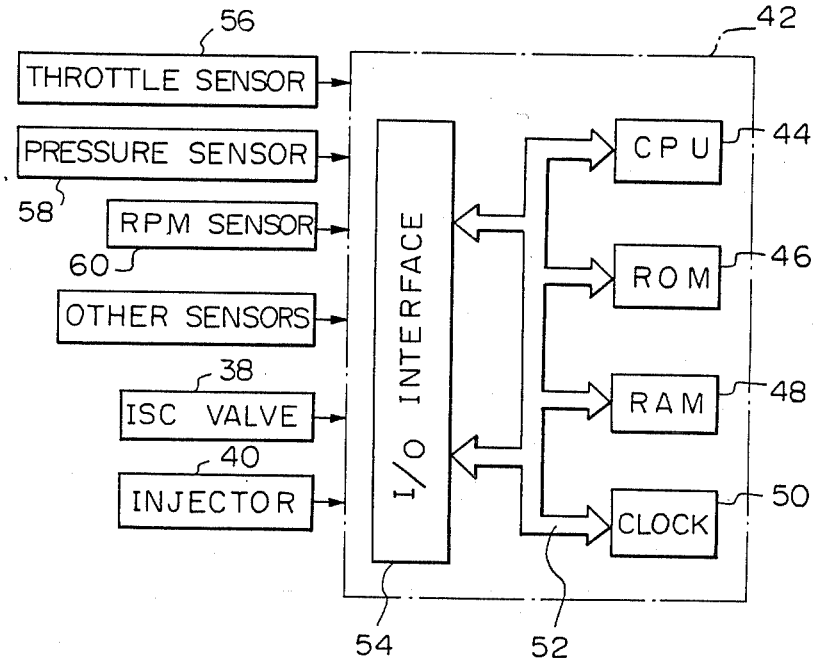
FIG. 2 is a block diagram of a typical arrangement of the electronic control unit of FIG. 1.

An electronic control unit (ECU) 42 is provided to control the bypass valve 38 and the fuel injector 40. The electronic control unit 42 is constituted by a microcomputer system, as illustrated in FIG. 2, typically including a central processing unit (CPU) 44 having control and arithmetic functions, a read only memory (ROM) 46 having a program stored therein, a random access memory (RAM) 48, and a clock 50. A bidirectional bus 52 interconnects these units and connects these units to an input and output (I/O) interface 54.

Referring to FIGS. 1 and 2, the electronic control unit 42 receives signals from a plurality of sensors mounted on the engine. A throttle position sensor 56 is mounted on the throttle body 32 in association with the shaft of the throttle valve 34 to detect the degree of opening of the throttle valve 34, and a pressure sensor 58 is mounted on the surge tank 30 to detect the flow of intake air in units of pressure. Other detecting means can be used to detect the flow of the intake air, for example, a potentiometer type air flow meter is commonly used for detecting the flow in units of volume, and is arranged downstream of the air cleaner. A revolution sensor 60 is mounted in a distributor 62 in the ignition system and includes two detecting elements; one outputting a cylinder reference pulse during one revolution of the distributor rotor, and the other outputting a plurality of pulses, for example 24 pulses, during one revolution of the distributor rotor, as is well known. Further, a speed sensor 64 for detecting the speed of the automobile is mounted on a transmission 66 of the automobile. Further well known sensors are exemplified in FIG. 1, such as a temperature sensor 68 for detecting the temperature of the intake air, a temperature sensor 70 for detecting the temperature of the engine cooling water, and an oxygen sensor 72 arranged in the exhaust manifold 28.

Figure 5:
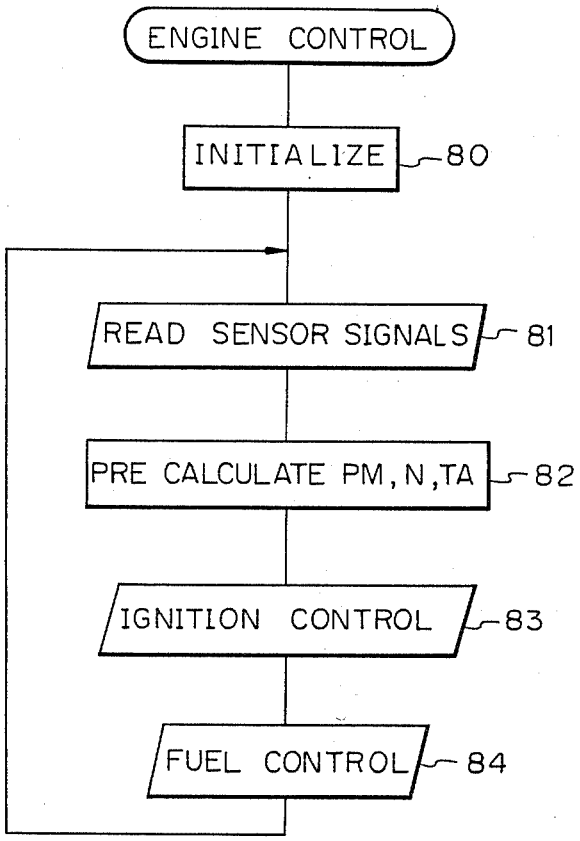
FIG. 5 is a flow chart for executing the electronic control of the engine.

FIG. 5 is a flow chart for a general control of the engine. Usually, the program is initialized (step 80) when the ignition switch is turned ON and control parameters are set to initial values, respectively. One such control parameter is a throttle correction factor TAc, which is important in the present invention. The throttle correction factor TAc is renewed in accordance with the learning operation of the present invention, described later, and stored in a suitable memory. The initialize operation includes a reading of this throttle correction factor TAc from that memory and a write thereof to the RAM 48. Subsequently, the execution starts and detected sensor signals are read (step 81). At the initial stage of the execution, some signals are pretreated (step 82) to convert the detected signals, for example, the pressure of the intake air (PM), revolution of the engine (N), and throttle opening degree (TA), to a suitable form or units adapted for the program, for example, the output of the revolution sensor 60 is converted from a pulse output to rpm, and thus the desired calculation can be carried out by using the desired sensor outputs. The ignition control (step 83) and fuel injection control (step 84) shown are typical of a general engine control. These engine control steps are repeated in a very short time period, for example, 4 milliseconds.

Figure 6:
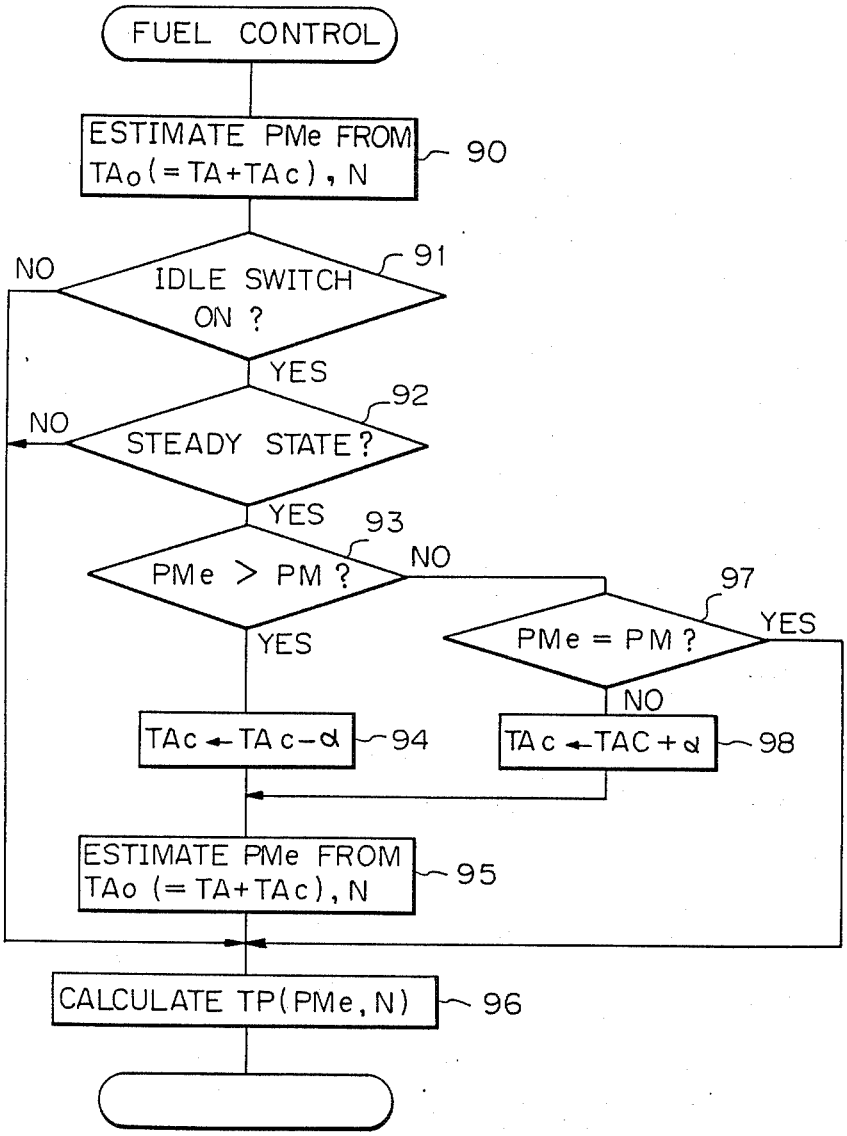
FIG. 6 is a flow chart showing a detail of a part of FIG. 5, including the estimating and learning steps.

FIG. 6 shows the details of a part of this fuel injection control. Note, although the electronic control unit 42 controls the bypass (ISC) valve 38 and the fuel injector 40, the bypass valve 38 can be controlled conventionally to provide a desired idle speed of the engine, and thus the details of the bypass valve 38 are omitted here. Also, the fuel injector 40 comprises a solenoid operated valve and only the opening time period of the injector 40 need be determined for injecting the desired amount of fuel.

The amount of fuel to be injected must be decided in accordance with the engine load, as estimated by the flow of intake air. Thus, many conventional control devices make this calculation in response to the outputs from the pressure sensor 58 or the potentiometer type air flow meter, as previously described. In the control device according to the present invention, however, this calculation is made in response to the output from the throttle position sensor 56, with the aid of a learning means and an estimating means, as shown in FIG. 1, which are embodied in the program exemplified in the flow chart of FIG. 6. The relationship shown in FIG. 4 is used for the estimation.

Figure 3:
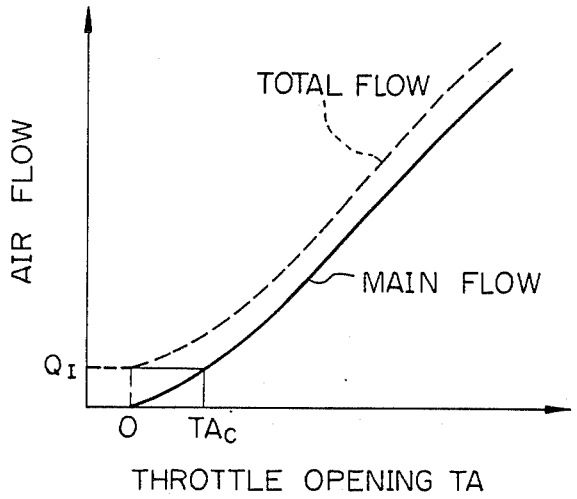
FIG. 3 is a graph showing the relationship between the degree of opening of the throttle valve and the flow of the intake air.

Referring here to FIG. 3, showing the air flow relative to the opening degree of the throttle valve 34, the solid line shows a main flow which passes through the throttle body 32 and the dotted line shows a total flow which passes through the throttle body 32 and the bypass air passage 36. The throttle position sensor 56 includes an idle switch which produces an "ON" signal when the throttle valve 34 is full closed, i.e., in an engine idle condition. The throttle position sensor 56 output is zero at the "ON" signal and increases, as represented by the solid line, in a generally linear relationship to the flow. The bypass flow is represented by $Q_i$, which corresponds to the main flow at a throttle opening degree TAc, and thus the total flow can be read from the solid line at a substantial throttle opening degree TAo consisting of the detected throttle opening degree TA plus the bypass corresponding throttle opening degree TAc. As is well known, the bypass flow changes in accordance with the engine operating condition, and therefore, the bypass corresponding throttle opening degree TAc is a variable and is referred to as a throttle correction factor.

Figure 4:
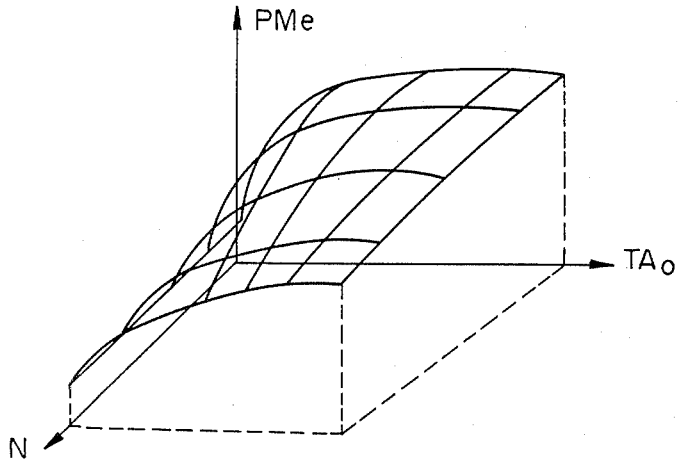
FIG. 4 is a three-dimensional graph of the predetermined load estimation value relative to the degree of opening of the throttle valve and the revolution speed of the engine.

FIG. 4 shows a load estimation value PMe, which is predetermined and stored in the ROM 46 as a two dimensional map of the substantial throttle opening degree TAo and the revolution speed of the engine N. Therefore, it is possible to calculate the load estimation value PMe from TAo and N. Note, the revolution speed N is readily available, as stated above, and the load estimation value PMe is represented by units of pressure, since the pressure sensor 58 is used for the learning. If a potentiometer type air flow meter is used, the load estimation value may be represented by the volume of the intake air (Q lit/N).

Referring to FIG. 6, at step 90, the load estimation value PMe is estimated from the map of FIG. 4 by sensing the throttle opening degrees TAo and the revolution speed of the engine N. At step 91, it is determined whether or not the idle switch is "ON" and if yes, the program goes to step 92. At step 92, it is determined whether or not the engine is operating in a steady state. The steady operating condition is detected by determining if the variation of pressure detected by the pressure sensor 58 is lower than a predetermined value or if the variation in the degree of opening of the throttle detected by the throttle position sensor 56 is lower than a predetermined value. Namely, the steady state is defined such that the engine is operating constantly during a given time period. In this embodiment, the steady state is detected when an idle running condition is determined at step 91. If the result is yes at step 92, the program goes to step 93 to carry out the learning procedure. If the result is no at step 91 or 92, then the program directly goes to step 96.

At step 93, it is determined whether or not the load estimation value PMe (calculated at step 90) is larger than the detected pressure PM of the intake air. If the result is yes, the program goes to step 94, at which the throttle correction factor TAc is renewed by subtracting a predetermined value $\alpha$, from the stored throttle correction factor TAc. Then, at step 95, the load estimation value PMe is further estimated, as in step 90, but usig the renewed throttle correction factor. Then the program goes to step 96.

If the result is no at step 93, then it is determined whether or not the load estimation value PMe equals the detected pressure PM (at step 97). If the result is yes at step 97, the program goes to step 96. If the result is no at step 97, the program goes to step 98, where the throttle correction factor TAc is renewed by adding $\alpha$ to the stored throttle correction factor TAc. Then, at step 95, the load estimation value PMe is further estimated.

At step 96, the amount of fuel to be injected is calculated in response to the load estimation value PMe obtained from the output of the throttle position sensor 56 and the detected revolution speed N. In this step, the opening time period TP of the fuel injector 40, which apparently corresponds to the amount of the fuel, is calculated. The details of this step are omitted here since the load estimation value PMe is represented in units of pressure and thus the conventional manner of calculation can be applied to the present invention.

In the preferred embodiment, the steady state of the engine is detected at step 92. At the previous step 91, the steady state detecting condition is restricted to occur only during the idle condition to properly adapt the fuel injection control device for idle variations. Therefore, when the result is no at steps 91 and 92, the program goes from step 90 to step 96, using the throttle correction factor TAc obtained during the previous idling condition. If the engine is next brought to the idle condition, then a new learning procedure will be carried out.

Figure 7:
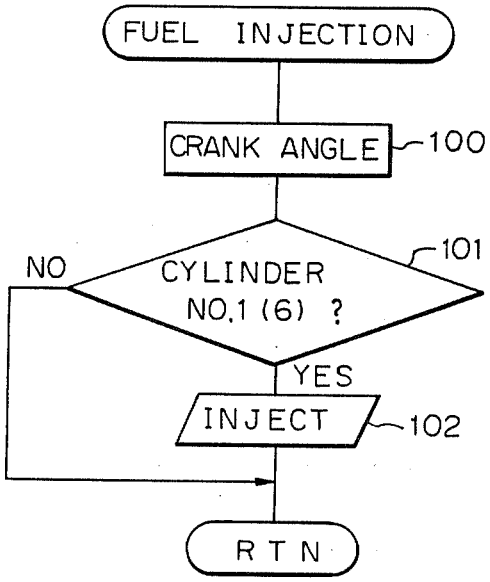
FIG. 7 is a flow chart for carrying out the fuel injection.

FIG. 7 is a flow chart for carrying out the fuel injection, which is started by an interruption signal produced at every 30° crank angle by the revolution sensor 60. The crank angles are calculated at step 100, to determine the crank position of the engine, using a counter in which the count is based on 24 pulse signals by the revolution sensor 60, and then at step 101, it is determined whether or not the No. 1 cylinder or No. 6 cylinder of the engine is now at the initial stage of the suction stroke. This determination is carried out for a synchronous injection, and is carried out twice in one engine cycle; namely, at the suction stroke of the Nos. 1 and 6 cylinders. If the result is no at step 101, the program is returned for the next interruption, since a fuel injection is not needed. If the result is yes at step 101, the program goes to step 102, where the fuel injection signal is delivered to the output port to open the fuel injector 40, and the fuel injection time period TP, measured from that instance and indicating the termination of the fuel injection, is set in the timer.

Figure 8:
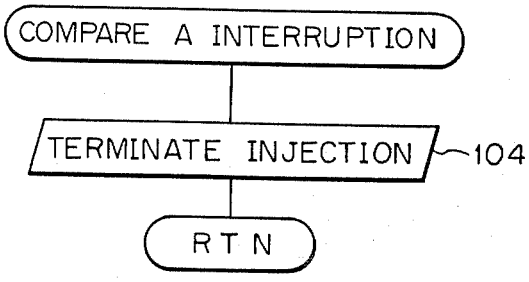
FIG. 8 is a flow chart for terminating the fuel injection.

FIG. 8 is a flow chart for a termination of the fuel injection. As shown at step 104 in FIG. 8 a compare interruption means is provided in association with the above timer to compare the elapse of time from the set time for producing an interruption signal, to terminate the fuel injection and thereby close the fuel injector 40.

We claim:

1. A fuel injection control device for an internal combustion engine having an intake air passage with a throttle valve and a fuel injector arranged therein, said device comprising:

a first detecting means for detecting a degree of opening of said throttle valve;

a second detecting means for detecting a flow of intake air in said intake air passage in units of a certain physical quantity;

a third detecting means for detecting whether or not the engine is operating in a steady state;

means for estimating a load of the engine from an output of said first detecting means in accordance with a predetermined estimation to provide a load estimation value represented by said units;

learning means for correcting the load estimation value provided by the estimating means based on the output of said second detecting means when said third detecting means detects that the engine is operating in a steady state; and means for calculating an amount of fuel to be injected in response to the most recently corrected load estimation value obtained from the output of said first detecting means.

2. A fuel injection control device according to claim 1, wherein said second detecting means comprises a pressure sensor arranged downstream of said throttle valve.

3. A fuel injection control device according to claim 1, wherein said second detecting means comprises a potentiometer type air flow meter, which detects a volume of an intake air flow.

4. A fuel injection control device according to claim 2 or 3, wherein said estimating means comprises means for storing a load estimating value represented by said units in a predetermined relationship to a degree of opening of the throttle and means for calculating the load estimating value from said predetermined relationship by adapting the detected degree of opening of the throttle, said estimation being corrected by applying a correction factor to said detected degree of opening of the throttle upon a calculation by the estimation means.

5. A fuel injection control device according to claim 4, wherein said learning means includes means for comparing a calculated load estimation value with a detected intake air flow to change said correction factor so as to decrease the difference therebetween.

6. A fuel injection control device according to claim 1, wherein said third detecting means comprises means for detecting that a variation of the degree of opening of the throttle detected by said first detecting means is lower than a predetermined value.

7. A fuel injection control device according to claim 6, wherein the variation of the degree of opening of the throttle is detected when the engine is in an idle condition.

8. A fuel injection control device according to claim 1, wherein said third detecting means comprises means for detecting that a variation of the intake air flow is lower than a predetermined value.

9. A fuel injection control device according to claim 8, wherein said variation of the intake air flow is detected by said second detecting means.

10. A fuel injection control device according to claim 9, wherein said variation of the intake air flow is detected when the engine is in the idle condition.

11. A fuel injection control device according to claim 1, wherein said engine has a bypass air passage for allowing air to bypass said throttle valve and a bypass valve arranged therein.

* * * * *

UNITED STATES PATENT AND TRADEMARK OFFICE

CERTIFICATE OF CORRECTION

PATENT NO. : 4,785,785

DATED : 22 November 1988

INVENTOR(S) : Hidehiro OBA et al.

It is certified that error appears in the above-identified patent and that said Letters Patent is hereby corrected as shown below:

| Column | Line | |
|---|---|---|
| 2 | 65 | Before "correcting" insert --means for--; before "estimation" insert --load--; before "provided" insert --value--. |
| 2 | 66 | Delete "device" and insert --means--. |
| 6 | 2 | Change "full" to --fully--. |
| 6 | 57 | Change "usig" to --using--. |

Signed and Sealed this

Twenty-third Day of May, 1989

*Attest:*

DONALD J. QUIGG

*Attesting Officer*

*Commissioner of Patents and Trademarks*